US010730658B2

(12) United States Patent
Dhadda et al.

(10) Patent No.: US 10,730,658 B2
(45) Date of Patent: Aug. 4, 2020

(54) RETAIL DISPLAY CARTON

(71) Applicant: Intercontinental Great Brands LLC, East Hanover, NJ (US)

(72) Inventors: Jaswinder Dhadda, Toronto (CA); Robert Goldberg, Toronto (CA); Enzo Vecchiarelli, Toronto (CA); Leonard S. Scarola, East Hanover, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

(21) Appl. No.: 16/070,481

(22) PCT Filed: Jan. 19, 2017

(86) PCT No.: PCT/US2017/014037

§ 371 (c)(1),
(2) Date: Jul. 16, 2018

(87) PCT Pub. No.: WO2017/132040

PCT Pub. Date: Aug. 3, 2017

(65) Prior Publication Data

US 2019/0023450 A1 Jan. 24, 2019

Related U.S. Application Data

(60) Provisional application No. 62/286,736, filed on Jan. 25, 2016.

(51) Int. Cl.
*B65D 5/54* (2006.01)
*B65D 77/04* (2006.01)
(Continued)

(52) U.S. Cl.
CPC ..... *B65D 5/542* (2013.01); *B65D 5/4212* (2013.01); *B65D 5/52* (2013.01); *B65D 77/042* (2013.01)

(58) Field of Classification Search
CPC ..... B65D 5/542; B65D 5/4212; B65D 5/52; B65D 77/042; B65D 5/54
(Continued)

(56) References Cited

U.S. PATENT DOCUMENTS 2,098,909 A * 11/1937 Angier ..... B65D 5/4283 229/198.1
2,391,791 A * 12/1945 McHenry ..... B65D 5/62 229/198.3

(Continued)

FOREIGN PATENT DOCUMENTS

DE 8013896 8/1980
GB 2449886 12/2008

(Continued)

OTHER PUBLICATIONS

International Preliminary Report on Patentability, dated Aug. 9, 2018 for International Application No. PCT/US2017/014037 (8 pgs.).

(Continued)

*Primary Examiner* — Christopher R Demeree
(74) *Attorney, Agent, or Firm* — Fitch, Even, Tabin & Flannery LLP

(57) ABSTRACT

A shipping carton displays two rows of packaged products stacked upon one another with package indicia facing a front opening. The carton (100) includes a top opening through which the packaged products are loaded in a vertical orientation. The top opening is closable by two opposing flaps (112) that adjoin along a top center line (114), and sealable with an adhesive strip (120) that extends along the top and onto opposing front and back surfaces of the container. The carton also includes a removable panel (160) defined by a line of weakness (162) spanning across the front surface and an adjacent side surface. The removable panel defines two protrusions (170) on opposing sides of the opening on the (Continued)

front surface. A portion of the adhesive strip (120) closing the top opening extends onto one of the protrusions (170).

18 Claims, 13 Drawing Sheets

(51) Int. Cl.
*B65D 5/42* (2006.01)
*B65D 5/52* (2006.01)

(58) Field of Classification Search
USPC .... 229/242, 243, 244, 240, 103, 122, 162.1, 229/162.7, 235; 206/736, 774, 738, 746
See application file for complete search history.

(56) References Cited

U.S. PATENT DOCUMENTS 2,786,789 A * 3/1957 Carlson ..... B31D 1/0062 229/198.1
3,829,006 A * 8/1974 Spiegel ..... B65D 5/542 229/237
3,884,348 A 5/1975 Ross
5,706,953 A 1/1998 Polvere
6,168,027 B1 * 1/2001 Esser ..... B65D 5/48014 206/738
6,435,351 B1 * 8/2002 Gibb ..... B65D 5/542 206/736
7,080,736 B2 7/2006 Jackson
8,342,335 B2 * 1/2013 Couture ..... B65D 5/5445 206/746
8,439,187 B2 5/2013 Tumminia
8,752,708 B2 6/2014 Keefe
8,813,965 B2 8/2014 Cheema
8,844,728 B2 9/2014 James
8,998,074 B2 4/2015 Schomisch
9,022,276 B2 5/2015 Little
9,061,791 B2 6/2015 Cameron
9,090,037 B2 7/2015 Swenson
2005/0184139 A1 * 8/2005 Gasior ..... B65D 5/0227 229/240
2005/0263434 A1 * 12/2005 Tibbels ..... B65D 5/0227 206/767
2011/0021917 A1 1/2011 Morita
2011/0186476 A1 * 8/2011 Poitevin ..... B65D 5/5016 206/736
2012/0298732 A1 * 11/2012 Stewart ..... B65D 5/724 229/122
2017/0203872 A1 * 7/2017 Grace ..... B65D 71/34

FOREIGN PATENT DOCUMENTS

JP 2002002684 1/2002
JP 2005170413 6/2005
WO 2010010727 1/2010

OTHER PUBLICATIONS

International Search Report and the Written Opinion of the International Searching Authority, dated Mar. 21, 2017 for International Application No. PCT/US2017/014037 (16 pgs.).

* cited by examiner

RETAIL DISPLAY CARTON

CROSS REFERENCE TO RELATED APPLICATIONS

This application is a U.S. national phase application of International Application No. PCT/US2017/014037, filed Jan. 19, 2017, which claims benefit from U.S. Provisional Application 62/286,736, filed Jan. 25, 2016, which are each hereby incorporated herein by reference in their entirety.

TECHNICAL FIELD

The present disclosure generally relates to cartons for shipping products. More specifically, the present disclosure relates to shipping cartons that double as displays in retail environments.

BACKGROUND

Some retail environments display certain packages (e.g., food packages) on a store shelf within the carton or container that the packages ship. That is, in some environments it is convenient to receive a container of multiple packages, place the container on a shelf, and then configure the container for display.

Some shipping cartons are configured to be loaded in a vertical direction. That is, the shipping container has an opening on or within the top surface through which the packages or packaged products can be loaded from above. In this manner, some shipping cartons are configured to display food packages, such as cookie packages, in a vertical orientation. These cartons can pose problems, if the packages are designed to be read in a horizontal direction. That is, shipping cartons that display packages vertically are not ideal for packages with indicia (e.g., text or graphics that identify or advertise product) designed to be read horizontally.

SUMMARY

The present disclosure describes examples of a carton for storing and displaying packages. In some examples, the packages have front display surfaces that include indicia (e.g., text or graphics that identify and describe the packaged product) configured to be read in a horizontal orientation (e.g., an orientation that is rotated 90 degrees from the orientation by which the packages are loaded into the carton). The carton includes a plurality of panels forming the surfaces of the carton. The carton includes a side panel extending along a first side surface of the carton, and an opposing side panel along a second side surface of the carton. The carton also includes a front panel extending along a front surface of the carton, adjacent the first side panel, and an opposing rear panel along the rear surface of the carton. A top surface extends along an upper surface adjacent the side panels and the front and rear panels. The top panel forms a closable top opening through which the packages can be loaded from above. In this manner the packages can be loaded so that the indicia on the front display surfaces of the packages face the front panel of the carton. The closable opening includes two opposing flaps that adjoin along a top surface center line to close the reclosable top opening. A removable panel segment spans across two adjacent surfaces, or two adjacent panels, of the carton. For example, the removable panel may span across portions of the first side panel and the front panel. The removable panel is defined by a line of weakness (e.g., a score line, a tear line, a perforation line, etc.) that facilitates removal of the panel from the carton. In this manner, the removable panel can be removed to form a display opening in the carton. The carton can display the front surfaces of the packages through the display opening when the carton rests on a second side surface opposite the first side surface.

The present disclosure also describes methods of loading shipping cartons, for example, methods of loading one or more of the shipping cartons described herein. In one example, the method includes separating two opposing flaps to form an opening on a top surface of the carton and loading packages from above the carton through the opening. The loading includes arranging the packages into two adjacent rows of vertically arranged packages so that the primary indicia of the packages face toward the front surface of the carton. The method also includes folding the opposing flaps over the top opening so that they adjoin along a top center line, and closing the opening by applying an adhesive strip along the top center line so that the adhesive strip overlaps each of the two opposing flaps, and so that a portion of the adhesive strip extends onto a protrusion on the front panel.

Some described methods relate to the display of products in a shipping carton. For example, the shipping carton may be loaded with two adjacent rows of packaged products arranged so that indicia on front surfaces of the packaged products face toward a front surface of the shipping carton. In one example, the method involves removing a removable panel segment from the shipping carton by tearing the panel segment along a line of weakness that spans across a portion of the front surface of the shipping carton and a portion of an adjacent side surface of the shipping carton. The method also involves positioning the shipping carton in a display orientation such that the two adjacent rows of packaged products are arranged with one row stacked upon the other. In this manner, removing the removable panel establishes a display opening that displays the indicia on the front surfaces of the packaged products and that enables removal of the packaged products therethrough. Further, the opening forms two protrusions on opposing sides of the front surface of the shipping carton.

Another method involves displaying packages in a shipping carton. The shipping carton has a plurality of carton sides including one side that is the longest, i.e., it is as long as or longer than any other side. The method includes removing a removable panel segment from the shipping carton to establish a display opening. The removable panel segment spans across at least two sides of the carton, including the longest side. The method also includes orienting the shipping carton on a display surface so that the first carton side is viewable and so that the packages within the carton can be removed through the display opening. The carton is configured so that the packages are removed from sides of the carton different from the sides through which the packages are loaded.

DETAILED DESCRIPTION

Figure 1:
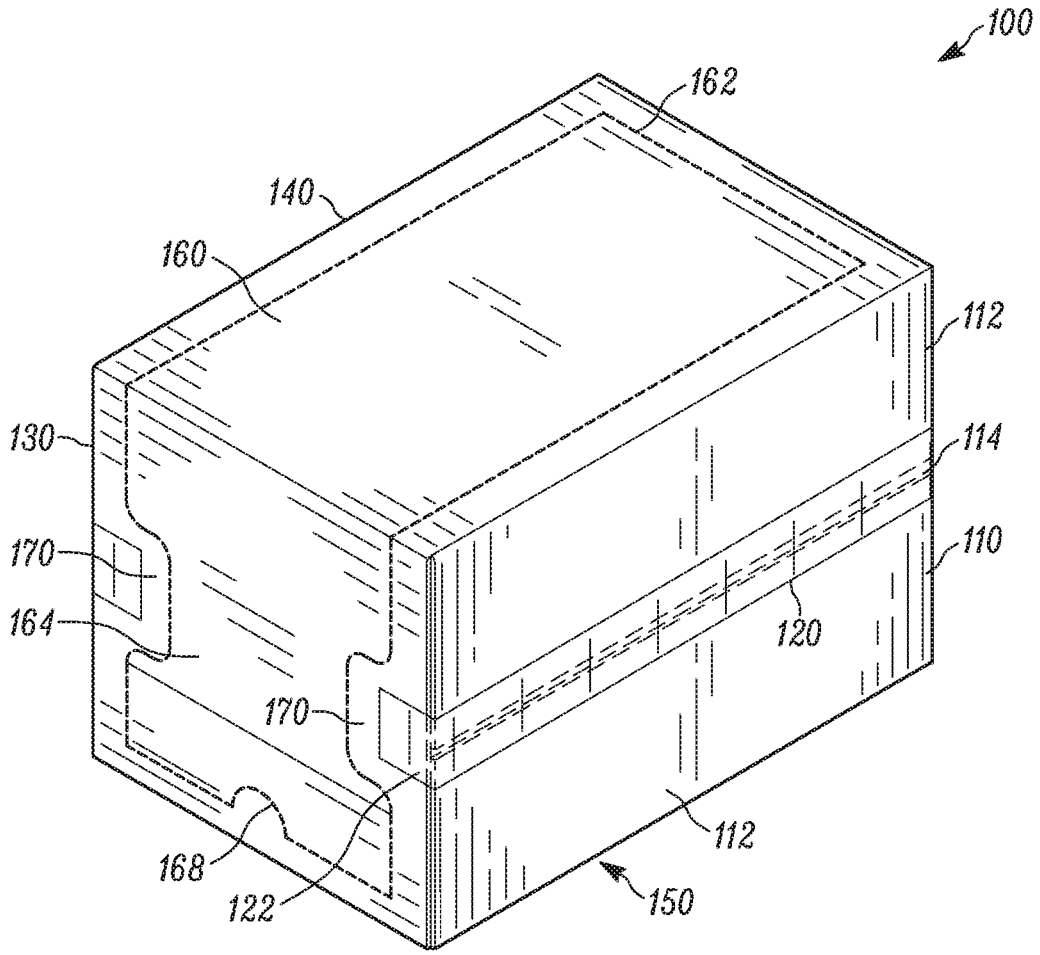
FIG. 1 shows a shipping carton with a removable panel segment arranged in a display orientation in accordance with examples of the present disclosure.

The present disclosure describes examples of a carton, in particular a shipping carton, that displays packaged products in a horizontal orientation. For example, the described cartons can be used to ship multiple packaged products, including food packages (e.g., packages of cookies, crackers, chips, etc.) to a retail establishment, and then converted into display cartons or containers at the retail establishment.

The described cartons allow the packaged products to be loaded into the container in a vertical orientation, for example, through an opening in the top of the carton. The carton can then be closed and sealed for shipping. Upon reaching the retail establishment, the carton can establish a display opening by removing a removable panel that extends across two adjacent panels of the package. The display opening reveals the packaged products stored within.

In some examples, the removable panel extends across sides of the carton that are adjacent the top opening. The container can thus be placed on a shelf in a horizontal orientation, with the top surface to the side, so that the display opening faces forward and upward. In this manner, the display opening can display the packaged products in a horizontal orientation. That is, the carton is configured so that vertically loaded packaged products can be situated and displayed horizontally. This improves packaging costs, while also improving display of the packages in the shipping carton when on a retail shelf. In some examples, depending on the display format, the carton configuration can optimize packaging costs as well. En other words, this carton configuration allows the packaging process to continue to use the previous top loading packaging equipment so the carton is loaded vertically, while also making the packages removable through a side and/or the front of the carton. Thus, the carton can rest on a shelf in a different orientation from which it is filled.

The present disclosure use words of orientation, direction, and/or position to describe certain components of the cartons and packages described herein. For example, the present disclosure may refer to panels of a carton as a "top" panel, a "side" panel, a "rear" panel, and the like. It should be noted that the described cartons and packages may be readily moved and re-oriented such that the orientation and position can change in different situations. As such, components and objects identified with such words of orientation, direction, and/or position may not be literally applicable in all configurations or orientations of the cartons or packages. For example, the present disclosure may use the terms "top panel" and "side panel" to refer to panels that are respectively on the top and the side of a carton that is in a first orientation (e.g., a loading orientation). However, as will be understood from the Figures and the context of the related disclosure, when such a carton is in a different orientation (e.g., in a display orientation), the top panel may be on the side, and the side panel be on a top or bottom of the carton. Moreover, the "top panel" may include more than one panel. For example, the "top panel" may include two opposing flaps that are folded to close an opening and sealed with an adhesive strip. In some examples, the top panel may be considered a top surface, a closed top opening, or simply a top.

FIG. 1 shows an example of a shipping carton 100 configured to display vertically loaded packages in a horizontal configuration. The shipping carton 100 of FIG. 1 is shown resting in a horizontal display configuration, whereby the top surface of the carton 100 is positioned on the right side of the figure, facing in a horizontal direction.

The carton includes a top panel 110 extending along the top surface (which here, is on the side) of the carton 100, a front panel 130 that extends along the front surface of the carton 100, and a first side panel 140 that extends along a side surface (which here, is on the top) of the carton. The carton also includes a second side panel 150 opposite the first side panel, a rear panel opposite the front panel, and a bottom panel opposite the top panel.

The top panel 110 includes two flaps 112 that lift up to form a top, or a loading opening in the carton 110. The flaps 112 fold down over the top surface to close the opening, adjoining along a top center line 114. As used herein, the term "adjoin" refers to components that lie next to or in contact with one another; not necessarily forming a physical connection.

A strip of adhesive 120 holds the two flaps 112 together in a closed position. The adhesive strip 120 can include a strip of tape (e.g., packing tape) that comprises adhesive on one or more surfaces, in particular, on the surface that is in contact with the carton 100. The adhesive strip 120 expands across all or a portion of the center line 114, and a portion 122 of the adhesive strip 120 may extend beyond the top panel onto the front panel 130 and the rear panel. In some examples, rather than an adhesive strip, the flaps 112 can be adhered together using another joining technique that does not involve an adhesive strip or tape. For example, the flaps can be held closed using glue or another adhesive, staples, ties, connectors, straps, pins, magnets, fasteners (e.g., hook and loop fasteners), or the like.

The carton 100 includes a removable panel segment 160 defined by a line of weakness 162 (which can be a score line, a perforation line, a tear line, etc.) that extends across the front panel 130 and the adjacent first side panel 140. The line of weakness can comprises a series of breaks, cuts, scores, or similar features that facilitates tearing of the panel segment 160. In this manner, the removable panel segment 160 can be removed from the carton 100 by tearing the segment 160 along the line of weakness 162. In some configurations, the line of weakness 162 can include a punch segment 168 or other initial break point that facilitates the initial removal of the panel segment 160. For example, the punch segment 168 can be a portion of the line of weakness 162 configured to break under less stress than other portions, for example, by including larger or deeper cuts than other portions of the line 162. The punch segment 168 can also be configured to serve as a notch or gripping portion that facilitates pulling or tearing of the removable segment 160 from the carton 100.

The line of weakness 162 may take on a variety of shapes and configurations. For example, as shown in FIG. 1, the perforation line may define an hourglass or dumbbell shaped configuration on the front panel 130 of the carton, whereby two protrusions 170 jut inward from opposing sides of the front panel 130.

The protrusions 170 can serve to provide additional surface area for the adhesive strip 120 to attach to the front panel 130. In some embodiments, the protrusions 170 will be designed to be wider than the adhesive strip 120 so that the portion 122 of the adhesive strip 120 can fit comfortably on the surface area of the protrusion 170, without extending over onto the front panel 130. Further, as discussed in more detail below, the protrusions 170 can also serve to provide structural support to the carton 100, and/or to support packages or other products stored within the carton 100 in a display configuration.

Figure 2A:
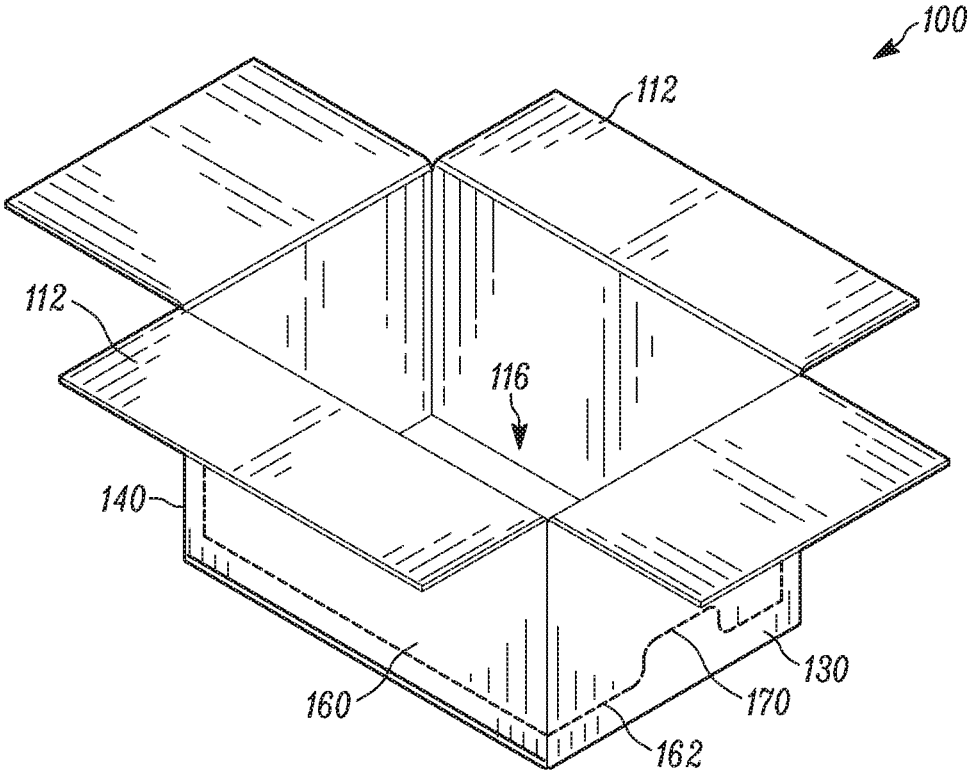
FIGS. 2A-C show a shipping carton being loaded with packaged products in accordance with examples described herein.
Figure 2B:
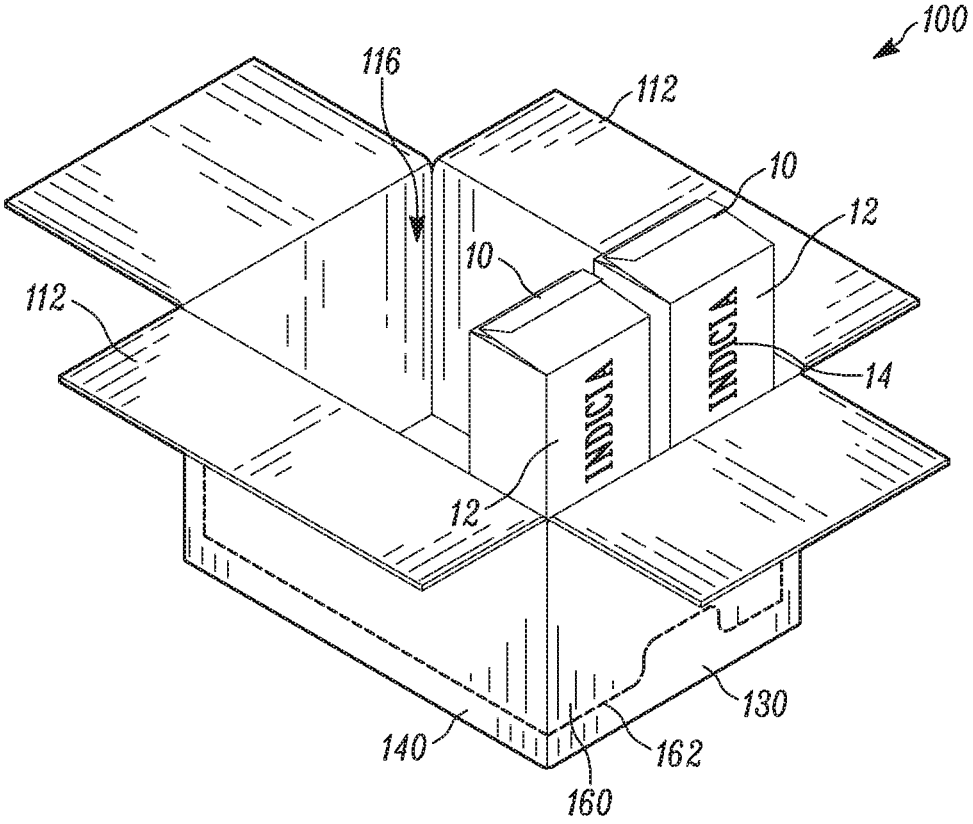
Figure 2C:
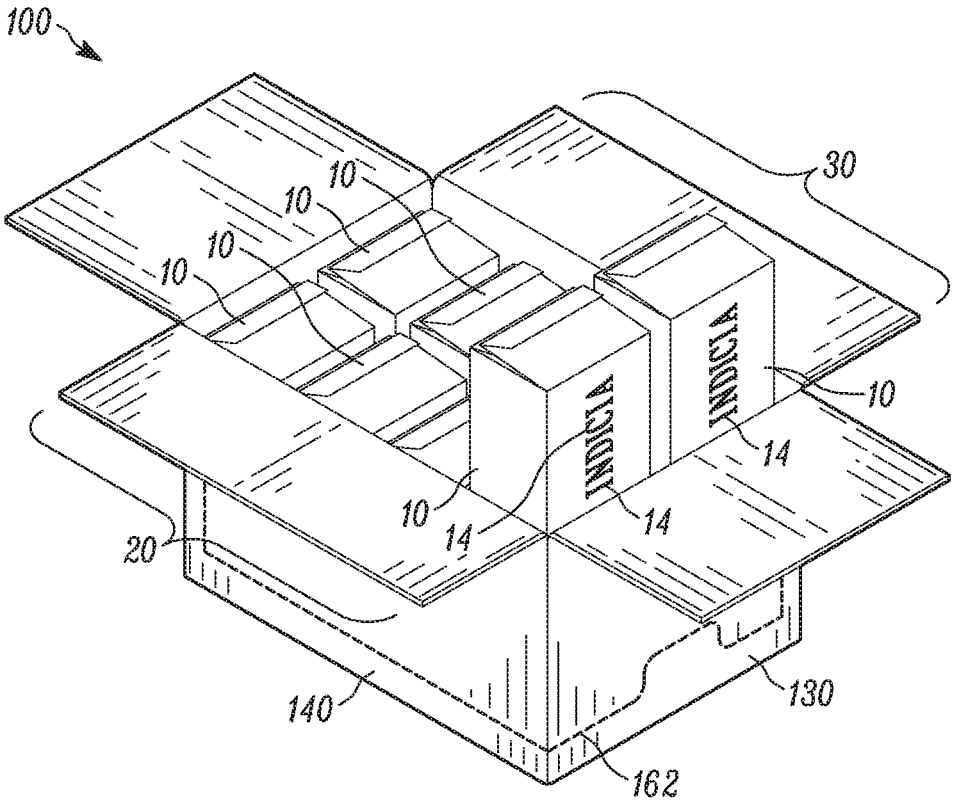

In some aspects, the carton 100 is loaded, or can be loaded with multiple packages, or packaged products. FIGS. 2A-C depict various stages of one technique for loading the carton 100. FIG. 2A shows the carton 100 in a loading configuration, with the top surface facing upwards, and with the flaps 112 folded up to define a top opening 116, or a loading opening. In this configuration, the front panel 130 faces toward the front of the carton 100, and the first side panel 140 is on a side of the carton 100, facing horizontally toward the left side of the Figure.

FIG. 2B shows two packages 10 being loaded into the carton 100 through the top opening 116 from above the carton 100. Each package has a front surface 12, which includes indicia 14. The packages 10 are loaded in the carton 100 so that the front surfaces 12 and/or the indicia 14 are facing the front surface or front panel 130 of the carton 100. As shown, thought the packages 10 are stacked vertically, the indicia is designed to be read in a horizontal configuration. Accordingly, configuring the carton 100 to display the packages 10 horizontally, rather than the vertical direction by which they are loaded, will allow the shipping carton 100 to double as a display carton in retail environments.

FIG. 2C shows the packages 10 being loaded into the carton 10 through the top opening 116 in two rows, including a first row 20 and a second row 30. While there is no meaningful distinction here between the first 20 and second rows 30, the packages 10 may be loaded so that the indicia read appropriately (i.e., the indicia 14 are right-side up) when the carton 10 is resting in a display configuration. That is, the packages 10 should be loaded into the carton 10 such that the bottoms of the indicia 14 face the second side surface 150 of the carton, and the tops of the indicia 14 face the first side surface 14. In this manner, when the carton 100 rests on the second side surface 150 in the display configuration, the first side surface 140 will form the upper surface of the carton, and thus, when the removable panel segment 160 is removed, the exposed packages 10 will present indicia 14 right-side up.

In some examples, depending on the shape, size, and structure of the packages 10 and/or the carton 100, more or less than two rows of packages can be loaded therein. For example, in some configurations, the carton 100 can be loaded with only 1 row of packages 10. In other configurations, three, four, or more rows of packages can be loaded into the carton 100. In such a configuration, the carton 100 will display three or four rows of products 10 stacked upon one another in the display configuration. In this manner, the packages may have a more stackable configuration, for example, the packages may take the form of flat or square boxes with a firm and stable structure, rather than thinner and/or flexible packages that may inhibit the stacking of multiple layers.

The packages 10 can be loaded into the carton 100 as shown in FIG. 2C until the desired capacity is met (e.g., until the carton 100 is full or nearly full), and then the top opening 116 of the carton can be closed and sealed. For example, FIG. 1 shows the flaps 112 of the top panel 110 folded over the opening 116 to close the opening. The flaps 112 adjoin along a top center line 114, and an adhesive strip 120 is applied to hold the flaps 112 in a closed position. As shown the adhesive strip 120 overlaps both flaps 112 and extends from the top panel 110 onto the front panel 130, and even onto the rear panel (not shown) of the carton 100. The carton 100 is shown in FIG. 1 resting on the second side panel 150 so that the first side panel 140 is facing upwards. In such a position, the carton 100 will be in a display configuration upon removal of the removable panel segment 160.

It should be noted that FIGS. 2A-C depict an example of a carton 100 pursuant to embodiments described herein, however, the process depicted in these figures can be applied to other embodiments. Indeed, this process is currently used to load existing cartons, though unlike the presently described technology, such existing cartons are not able to double as display cartons that display the packages 10 in a horizontal, stacked configuration.

Figure 3:
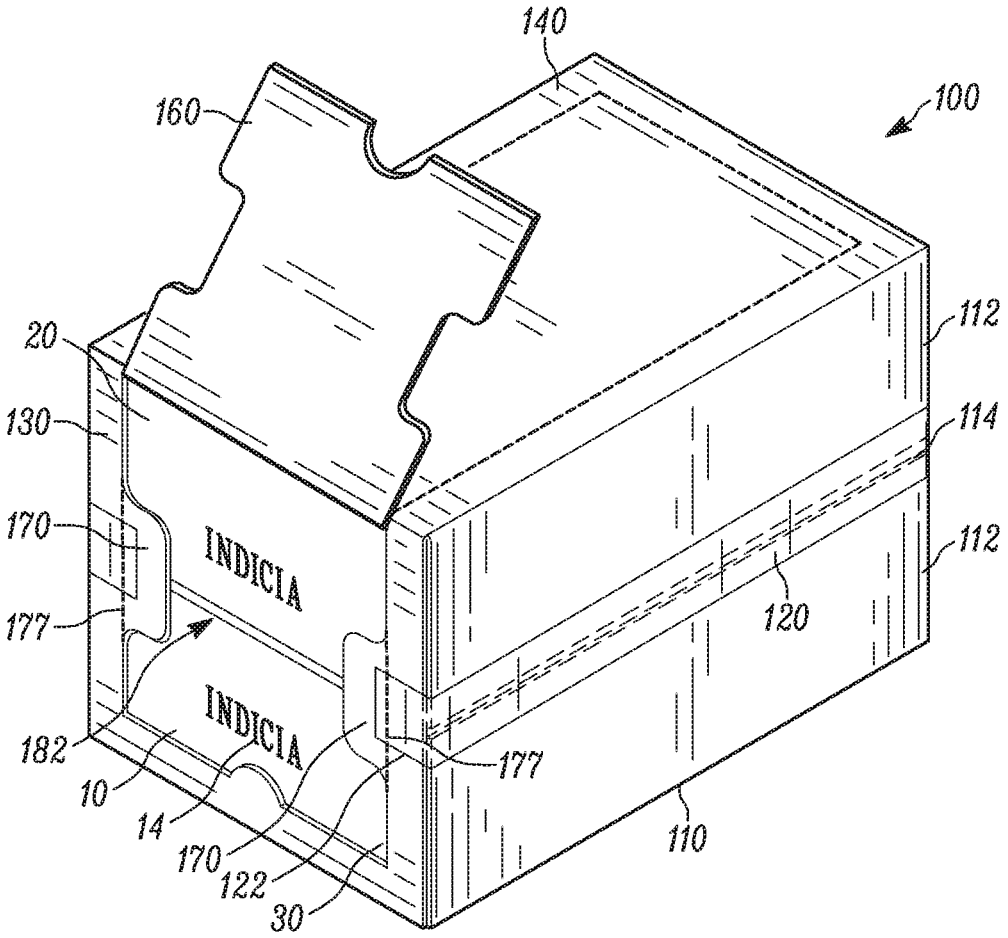
FIG. 3 shows the shipping carton of FIG. 1 as the removable panel segment is being removed from the front surface of the carton.

As noted above, the removable panel segment 160 removes from the carton 100 to produce a display opening through which the packaged products 10 can be displayed and removed, for example, by consumers at a retail environment. FIG. 3 shows an example of a shipping carton 100 as the removable panel segment 160 is being removed from the front surface 130 of the carton 100. In FIG. 3, the protrusions 170 are shown with fold lines 177 or crease lines that allow protrusions 170 to swing or bend away from the carton 100, thereby facilitating removal of the packages 10. In this manner, the fold lines can act as hinges that allow the protrusions to swing out like a door, thereby making space through which the packages 10 can be removed.

Figure 4:
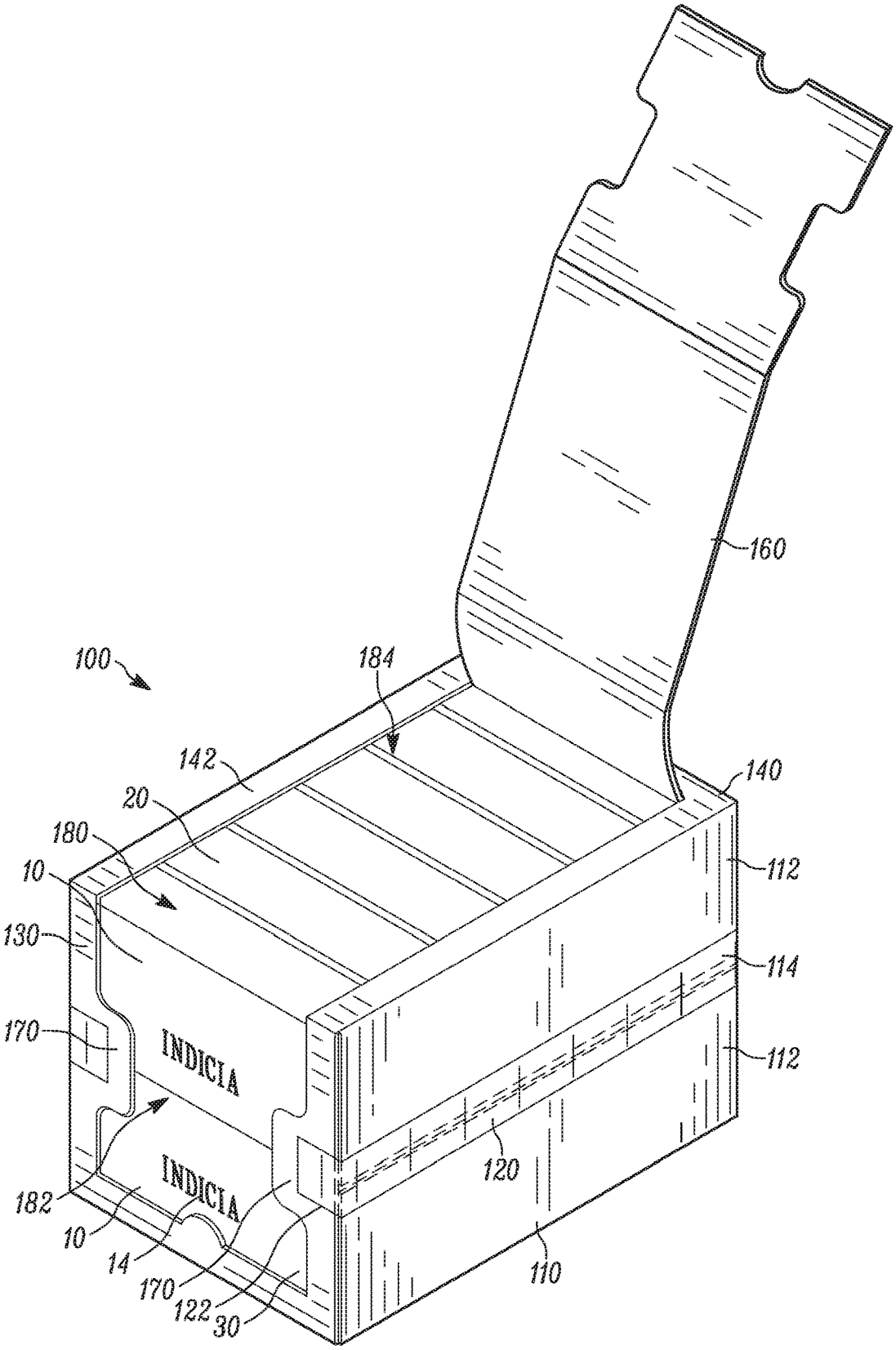
FIG. 4 shows the shipping carton of FIG. 1 as the removable panel segment is being removed from the first side surface of the carton.

FIG. 4 shows the carton 100 as the removable panel segment 160 is being removed from the first side surface 140 of the carton. The removable panel segment 160 is removed by peeling or pulling the segment 160 along the line of weakness 162, thereby separating the panel segment 160 from the carton 100.

Figure 5A:
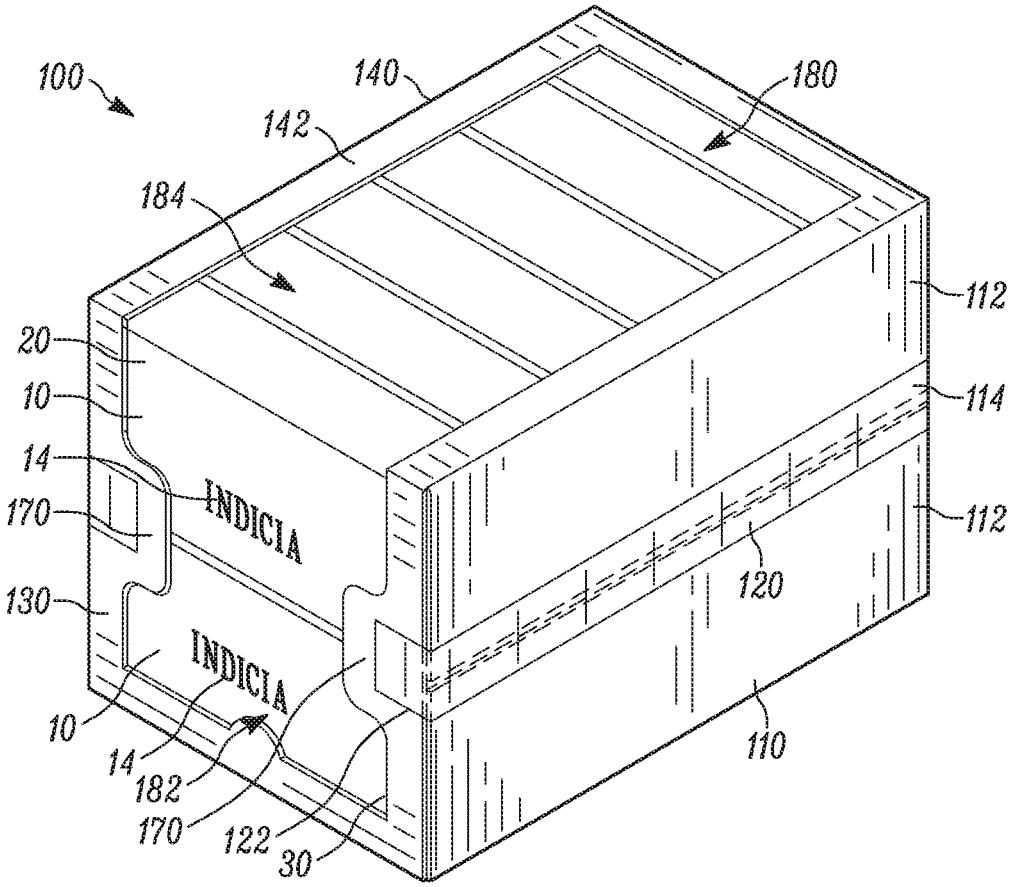
FIG. 5A shows the shipping carton of FIG. 1 with the removable panel segment fully removed and establishing a display opening.

FIG. 5A shows a carton 100 in a display configuration with the removable panel segment 160 fully removed and establishing a display opening 180. In the display configuration, the carton 100 rests on the second side surface 150 of the carton, with the first side panel 140 facing upward, and the top panel 110 facing horizontally. In this configuration, the vertically loaded packages 10 are displayed horizontally.

As can be seen through the display opening 180, and in particular, the front side portion 182 and the first side portion 184 of the display opening 180, the packages 10 are arranged in the carton 100 so that the first row 20 of packages are stacked on top of the second row 30 of packages in a horizontal arrangement. In this horizontal arrangement, the package indicia 14 are displayed in their intended format. That is, the indicia can be read horizontally, as normal text.

The display opening 180, including the front side portion 182 and the first side portion 184 are generally large enough to allow the packages 10 within the carton 100 to be removed, for example, by consumers in a retail environment. In some examples, the packages 10 may need to be arranged or angled in order to comfortably fit out of the opening 180. In other examples, the packages 10 may be flexible so that they can be slightly squeezed or deformed in a manner that facilitates removal through the display opening.

Some examples of the presently described shipping cartons 100 can be stacked on top of one another while in the display. The cartons 100 can be stacked on top of each other in a manner that still allows access to the packages 10 stored within. That is, the shipping cartons can be arranged so that, once the panel segment 160 is removed, packages 10 within a lower carton 100 can be removed through the front portion 182 of the opening 180 of a lower carton. In this manner, the carton 100 is configured to have structural strength to support the weight of additional cartons. Moreover, the carton 100 is also configured so that the first side 140 of the carton provides a surface 142 sufficient to support stacking of other cartons 100 even after the panel segment 160 has been removed.

FIG. 5A shows a shipping carton 100 with the removable panel segment 160 fully removed to establish a display opening 180. In this embodiment, the display opening 180 has a width that is generally consistent along the portion spanning between the front panel 130 and side panel 140. In some examples, the display opening 180 may be even wider along this portion to facilitate removal of the packages.

Figure 5B:
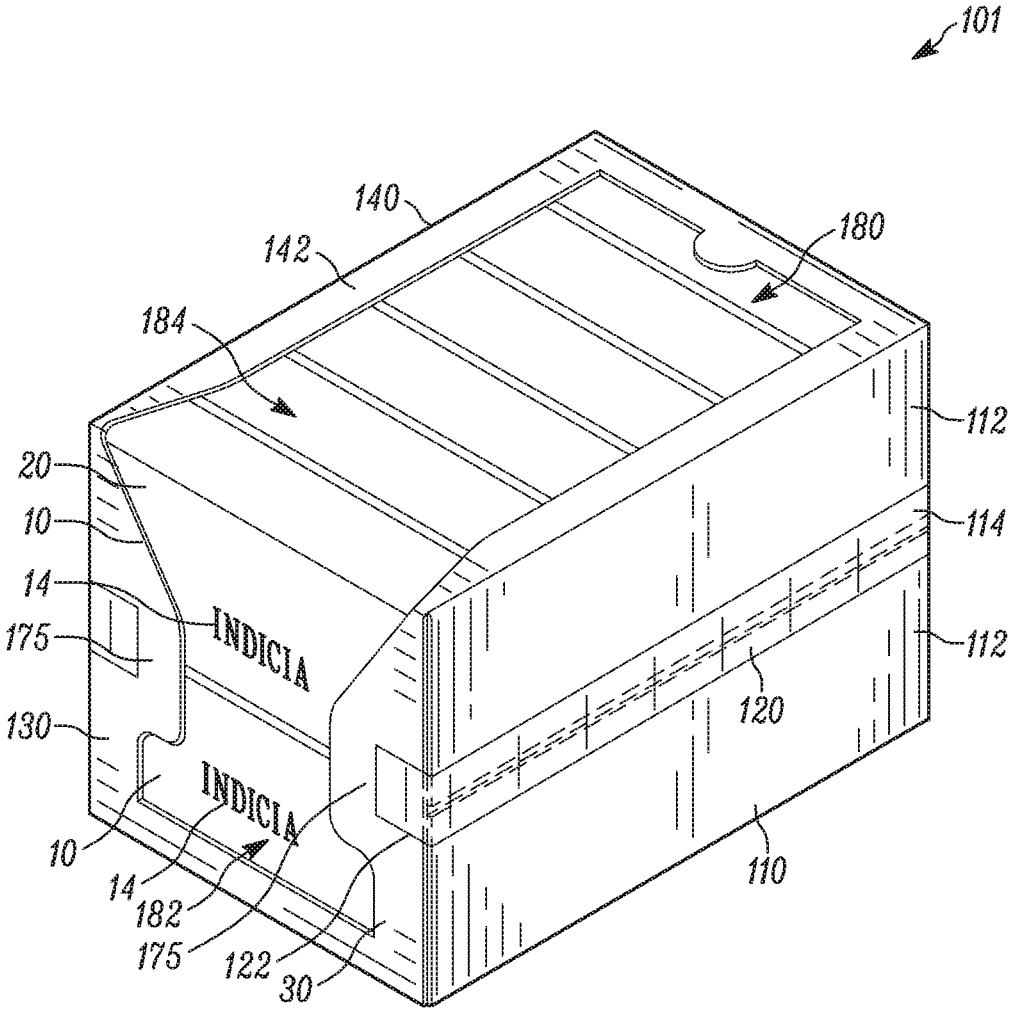
FIG. 5B shows another example of a shipping carton having a removable panel segment fully removed to establish a wider display opening.

For example, FIG. 5B shows a shipping carton 101 having a removable panel segment fully removed to establish a wider display opening. In this configuration, the display opening (established by removing a removable panel segment) forms a tapered portion across the edge adjoining the front panel 130 and the side panel 140 of the carton 101. This provides a display opening 180 that is wider along the portion of the carton connecting the front panel 130 and side panel 140. Here, the protrusions 175 are not symmetrical, however, the wider opening along the connecting edge between the front and side panels 130, 140 provides a wider opening 180 at a point where packages 10 may be grabbed and removed.

Figure 5C:
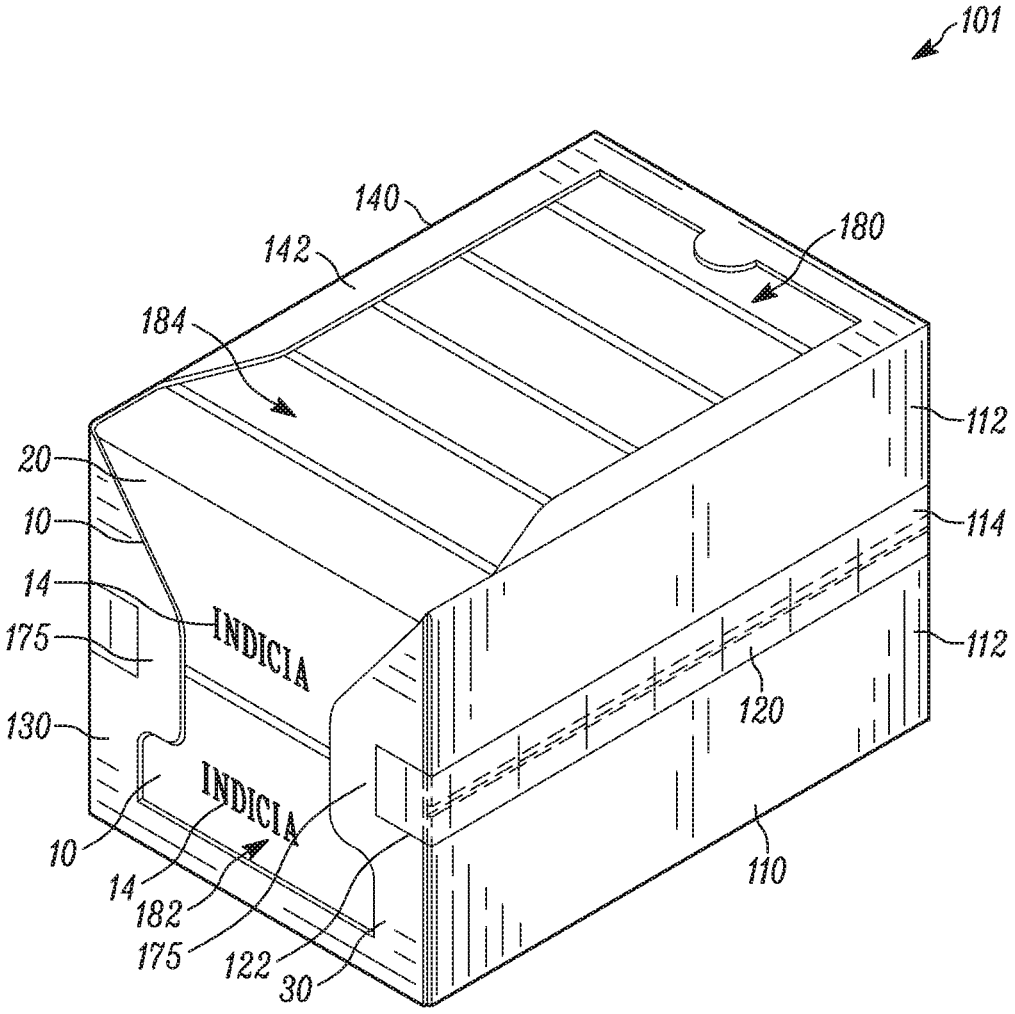
FIG. 5C shows another shipping carton having a removable panel segment fully removed to establish a further widened display opening.

FIG. 5C shows another example of a shipping carton 102 with a removable panel segment fully removed to establish a display opening 180 that is yet further widened. Here, the display opening 180 forms a opening on the front panel 130 (and in some embodiments, may establish a parabolic shaped opening), that extends to the edge of the carton 101, facilitating removal of the packages 10 through the side panel opening portion 184 thereby widening the display opening 180 even further along the adjoining edge portion. This further widening can facilitate removal of the packages 10 located within the carton 102, for example, as the packages 10 may be narrower than the widest part of the opening 180 at the point of removal.

In FIGS. 5B and 5C, the display opening 180 forms a wider display opening portion along the carton edge that adjoins the front panel 130 and the side panel 140. This wider display opening portion is formed by the shape of the removable panel segment 160 that removes to form the display opening 180. Accordingly, in such embodiments, the un-opened carton 101, 102 may include a line of weakness that defines a removable panel segment, wherthy the line of weakness includes at least one of a tapered segment or a parabolic segment along the front panel 130, the side panel 140, and/or the carton edge that adjoins the front panel 130 and side panel 140.

Figure 6:
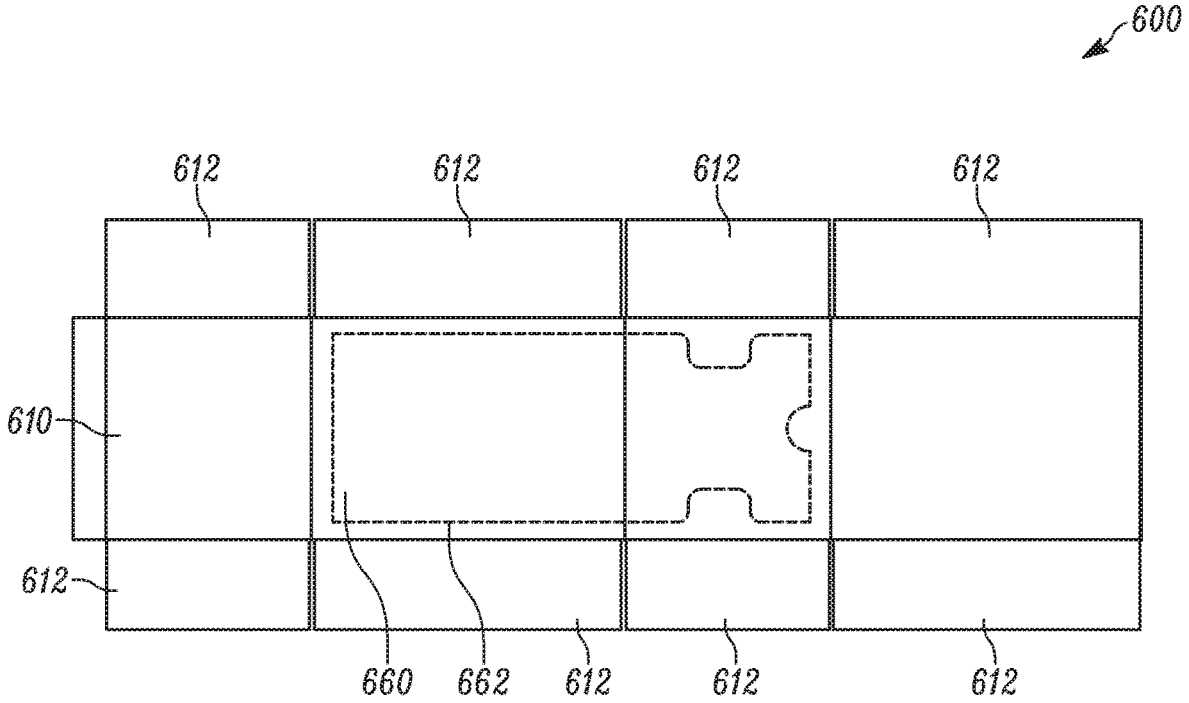
FIG. 6 shows a blank that can be configured to form a shipping carton in accordance with examples described herein.

FIG. 6 shows a blank 600 that can be configured to form one example of a shipping carton. The blank 600 includes a central panel 610 that folds to form the front, rear, and first and second side panels of the shipping carton. As shown, the line of weakness 662 spans across two adjacent front and side panels to define the removable panels segment 660. Extending from the central panel 610 are a series of flaps 612 that fold over to form the top and bottom panels of the shipping carton. In some aspects, certain flaps 612 can form flaps 112 described above with respect to FIGS. 1-5.

FIGS. 3-5C show the protrusions 170, 175, 176 after panel segment 160 is removed. The protrusions 170, 175, 176 are arranged to partially overlap the packages 10 from both the first row 20 and the second row 30. In this manner the protrusions can facilitate maintaining the packages 10 upright within the carton 100. Additionally and/or alternatively, the protrusions 170, 175, 176 can be configured to inhibit or prevent the packages 10 from falling out of the carton 100 or otherwise tipping over. That is, by extending over a portion of the packages 10, the protrusions can provide support that maintains the packages 10 in a desirable display orientation.

In some examples, the protrusions 170, 175, 176 generally align with the top center line 114. In this manner, the adhesive strip 120 that closes the top panel 100 can extend onto the protrusions 170, 175, 176, thereby providing more surface area that the at least a portion 122 of the adhesive strip 120 can adhere on or to. This additional surface area helps allow the adhesive strip 120 to establish a more secure closure of the top opening 116, thereby reducing the likelihood of unwanted packaging breakdown during the shipping process. Thus, the protrusions 170, 175, 176 may have a width (or at least some dimension) that is greater than the width (or some equivalent dimension) of the adhesive strip 120.

Moreover, the protrusions 170, 175, 176 can be configured so that a majority of the indicia 14 can still be seen and read. For example, the protrusions may be configured to be small enough so as not to overlap with the indicia 14 on the front surfaces 12 of the packages 10, or to only overlap with a small portion of the indicia 14 so that the package indicia can still be read and/or identified by passersby in a retail environment. In some examples, each of the protrusions 170, 175, 176 may be configured to extend over no more than no more than about 20 percent of the width of the display opening so that the packages 10 can be readily removed, and so that the indicia 14 on the packages can be readily read. That is, each protrusion may cover about 20%, for a combined total of 40% coverage of the display opening 160. The sizes and shapes of the protrusions may vary depending on the intended application of the carton and the packages 10 stored therein. For example, In some aspects, the protrusions 170, 175, 176 may extend over between about 1 percent to about 15 percent of the opening, more specifically between about 5 percent and about 12 percent of the width of the display opening 180, or even more specifically about ten percent of the width of the display opening 180. In other examples, a portion of each protrusion may extend over more than 20% of the display opening including 30%, 40%, or 45% of the opening, for example.

The FIGS. 1-5A show examples of a carton 100, whereby the protrusions 170 establish a dumbbell or hourglass configuration on the front panel 130 of the carton 100. FIGS. 5B and 5C show examples of cartons 101 and 102, whereby the protrusions 175 and 176 establish different configurations that resemble cocktail glasses or goblets more than a dumbbell or hourglass formation. It should nevertheless be understood that other shapes and configurations could also be employed. In particular, the shape and configuration of the protrusions, and the display opening could depend upon the shape, size, and type of packages 10 stored within the carton 100. For example, where the carton 100 is loaded with more than two rows of packages 10, each side of the front panel 130 may include two protrusions, each protrusion 170 partially overlapping with two rows of products. In some configurations, the protrusions 170 may be wider or narrower, depending on the size of the adhesive strip 120 securing the top panel 110 in the closed position. In other configurations a protrusion 170 (or protrusions) may only be formed on one side of the display opening 180, thereby providing a relatively linear configuration on the opposing side of the front panel portion 182 of the display opening 180. Additionally and/or alternatively, the embodiments of FIGS. 5B and 5C can also be employed, which utilize protrusions 175 and 176 that have asymmetrical shapes.

FIGS. 1-5C show cartons that are loaded with packages 10 in a vertical orientation, but that displays them in a horizontal orientation. It should be understood, however, that some embodiments could be employed to present other configurations. For example, some embodiments may employ a carton 100 that is designed to receive products loaded in a horizontal configuration, but displayed in a vertical orientation.

Some examples described herein present cartons, boxes, containers, or the like. In one example, a carton 100 is a box configured for storing and displaying packages 10. The packages 10 can include food packages, such as cookies, crackers, chips, or the like. The carton 100 can take on a rectangular or box-like shape that includes six surfaces or sides, including opposing top/bottom surfaces, opposing front/rear surfaces, and opposing right/left (or first/second) surfaces.

The exemplary carton 100 includes a side panel 110 extending along a side surface (e.g., a first side surface) of the carton 100 and a front panel 130 extending along a front surface of the carton 100 adjacent the first side panel 140. A top panel 110 extends along an upper surface of the carton 100 adjacent the side panel and the front panel. The top panel 110 forms a closable top opening 116, and has two opposing flaps 112 that adjoin along a top center line 114 to close the closable top opening 116. The flaps can be adjoined, for example, by an adhesive strip 120, such as a strip of tape that overlaps both flaps and extends onto the front panel 130 and the rear panel of the carton 100.

The carton also includes a removable panel segment 160 spanning across at least a portion of the first side panel 140 and the front panel 130. The removable panel segment 160 can be defined by a perforation line or other line of weakness 162 that spans the side panel and the front panel, thereby allowing the panel segment 162 to be removed to form a display opening 180, including a front panel opening portion 182 and a side panel opening portion 184.

The carton 100 is configured to display the packages 10 through the display opening 180. The packages 10 stored within the carton 100 can be grasped and removed through the display opening 180, for example, by consumers or other passersby in a retail environment. That is, the display opening 180 can be sufficiently large to enable removal of the packages 10 through the opening 180.

In some examples, the top opening 116 of the carton is configured to receive a first row 20 of packages and an adjacent second row 30 of packages through the top opening 116, whereby, the first 20 and second row 30 of packages 10 are received in a vertical orientation (e.g., standing upright). In some examples, the packages 10 have indicia 14 on a front surface 12 of the package 10. Thus, the top opening 116 can receive the two adjacent rows of vertically oriented packages so that the indicia on the front surface of the packages face toward the front panel of the carton.

In some examples, the indicia 14 on the packages 10 are arranged horizontally. That is, the indicia 14 can be provided on the packages 10 so that the indicia read from the top to the bottom (or from the bottom to the top) of the vertically loaded packages 10 in the carton. In this manner, the carton may be configured to display the packages in the horizontal orientation, whereby the first row 20 of packages is stacked upon the second row 30 of packages in the horizontal orientation.

As noted, removing the panel segment 160 exposes a display opening 180 in the carton 100. In some forms, the display opening 180 is configured so that the indicia 14 on the front surface 12 of at least one package 10 within the carton 100 is visible through the display opening 180, either through the front panel portion 182, the first side panel portion 184, and/or combinations thereof.

In certain configurations, the protrusions 170 of the carton 100 are arranged to extend over portions of both the first row 20 of packages 10 and the second row 30 of packages 10. In this manner, the protrusions 170 can provide support to the packages 10, helping the packages 10 remain within the carton 100 in an upright manner thereby improving display of the packages 10. In some configurations, the protrusions 170 are arranged so that a majority of the indicia 14 on the front surface 12 of the front-most packages 10 in the carton 100 remains uncovered, or largely uncovered, by the protrusion 170.

The previous described shipping cartons are all configured to hold and display packages that are arranged in two rows, with one package per row. Some examples described herein provide shipping cartons that hold and display packages that can be arranged with more than one package per row. In such a configuration, the shipping carton may include multiple removable panel segments so as to define multiple display openings, with each display opening being associated with a particular row of packages. A divider between each of the openings may provide stability to the package and may also help with the arrangement of the packages in their arranged position.

Figure 9:
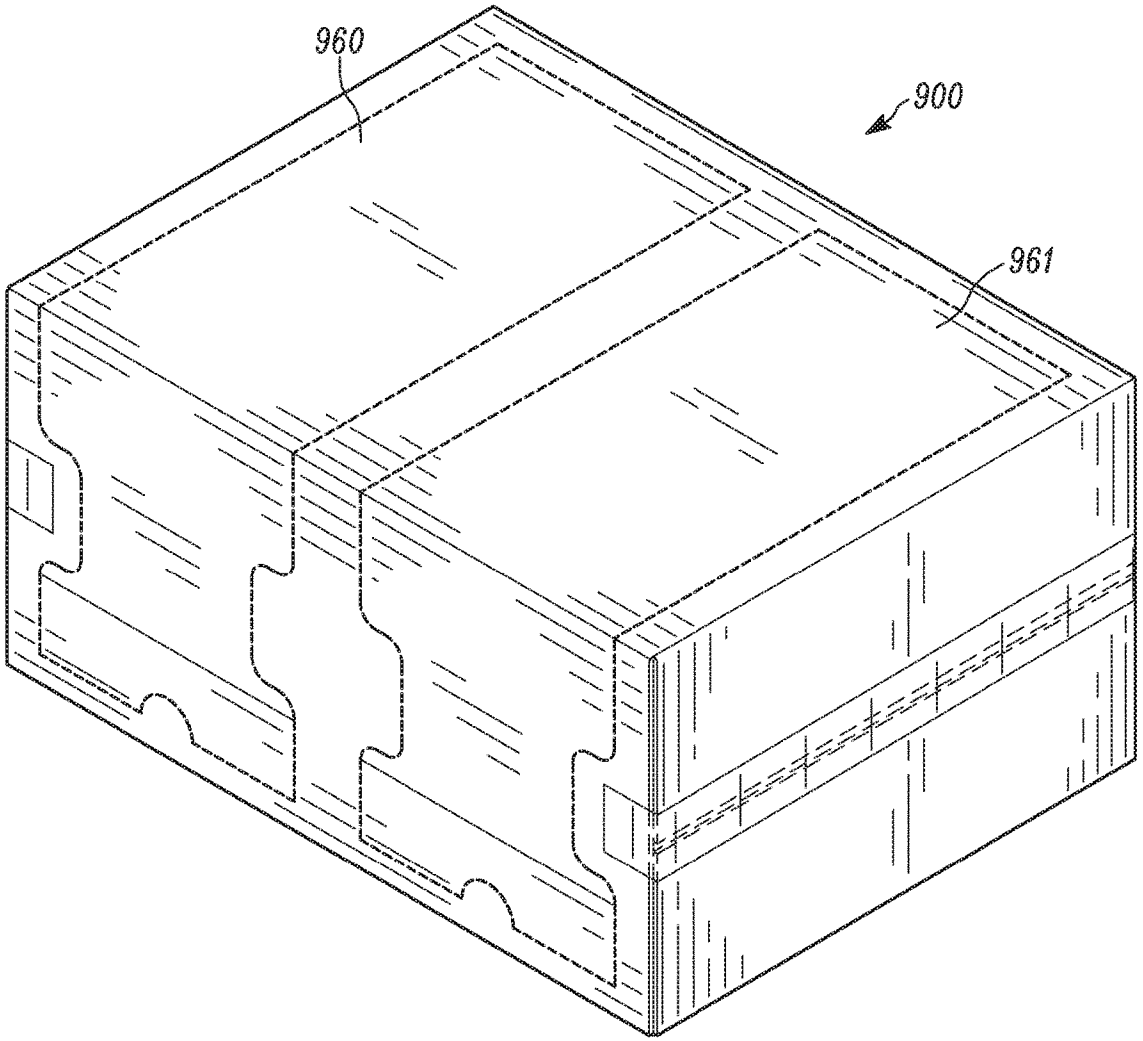
FIG. 9 shows a shipping carton with two removable panel segments in accordance with examples described herein.
Figure 10:
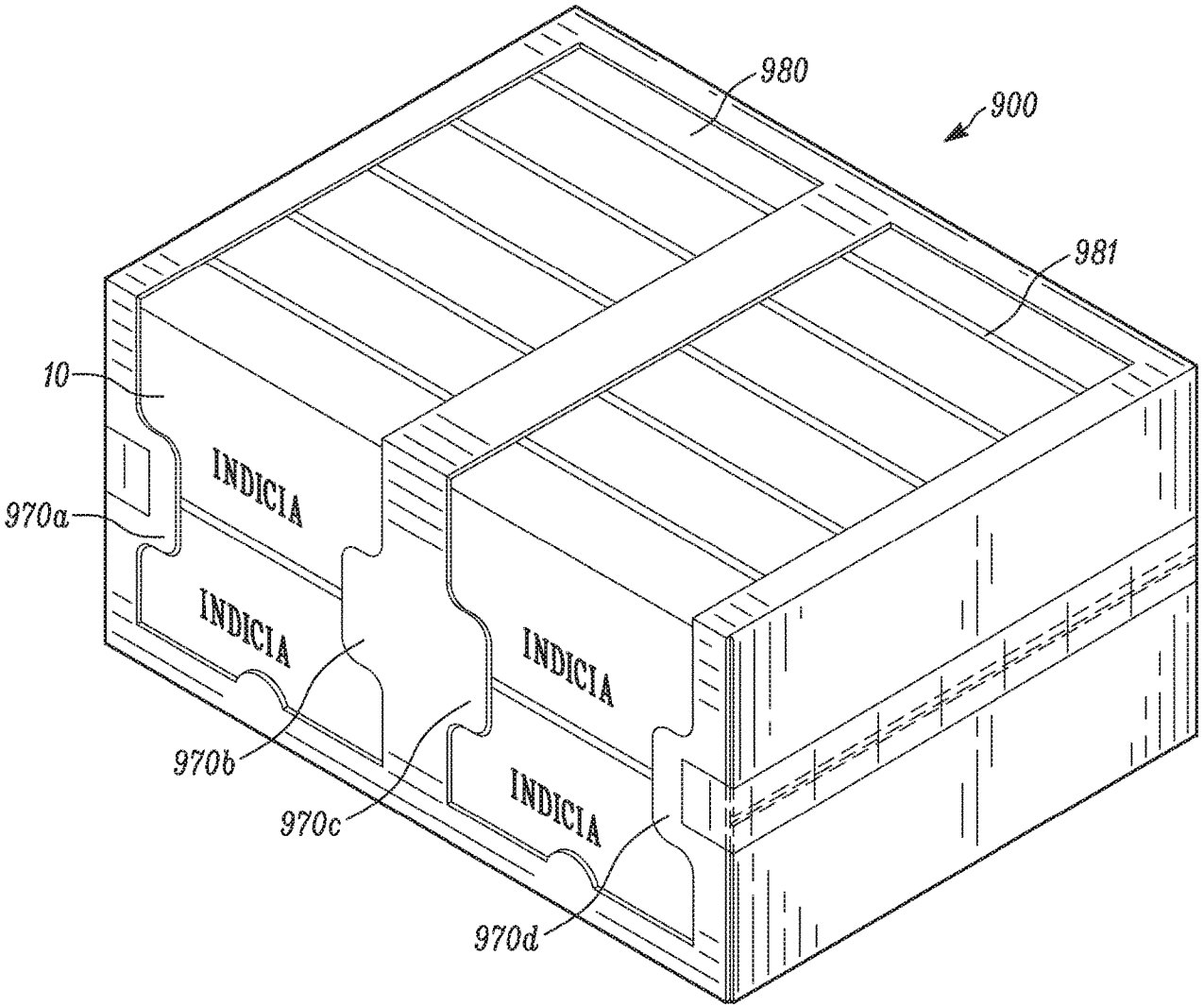
FIG. 10 shows the shipping carton of FIG. 9 with the two removable panel segments removed.

FIG. 9 shows a shipping carton 900 with two removable panel segments 960 and 961, and FIG. 10 shows the shipping with the two removable panel segments removed. As shown, the shipping carton 900 is twice as wide as the cartons shown in FIGS. 1-5, thereby allowing the carton to hold and display two or more packages 10 per row. In other configurations where the packages are smaller, the shipping carton 900 itself may be smaller, and not necessarily twice as wide as the other cartons.

The shipping carton in FIG. 9 has two removable panel segments 960 and 961, each of which is arranged with two separate columns of products. Upon removal of each of the two panel segments 960 and 961, the shipping carton forms two display openings 980 and 981, each corresponding to a column of packages 10. Packages from each column can be removed from the corresponding display opening 980 or 981.

Each display opening has two protrusions 970*n* that extend over the opening around the center of the package. To help provide structure to the package, and to help maintain the packages 10 in their originally oriented columns, the shipping carton 900 may have a divider wall (not shown) spanning the center of the carton. The divider wall can inhibit the packages in adjacent columns from falling to a middle point between the openings after one or more packages 10 are removed, thereby making the packages 10 difficult to reach and remove. The divider can be integral with the shipping carton 900, or it can be added as a removable segment. That is, where the packages 10 are loaded from the top panel, each of the packages 10 in the first column may be loaded first, then a divider wall or panel can be placed upon this loaded column of packages 10, on top of which the second column of packages 10 can be loaded. Where the divider wall is integral with the shipping carton 900, the packages may be loaded through another opening, for example, through an opening in the rear panel of the package.

Figure 7:
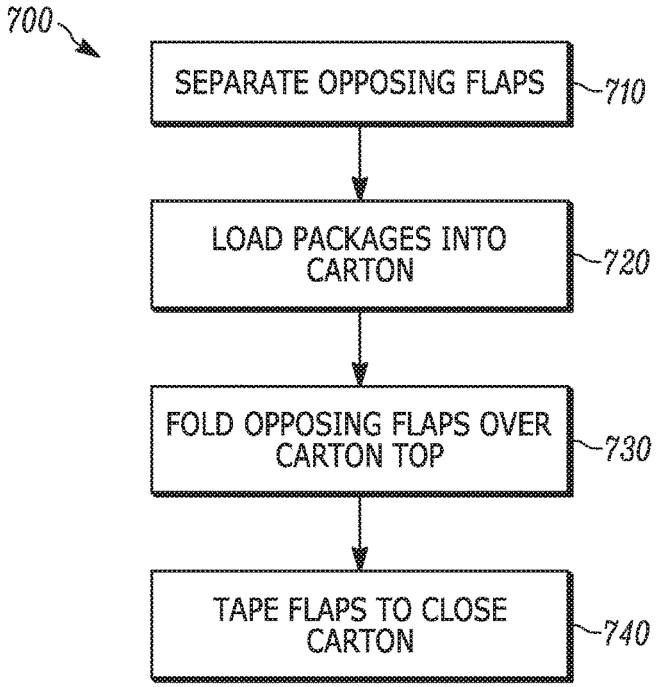
FIG. 7 is a flow diagram for a method of loading a shipping carton in accordance with examples described herein.

The present disclosure also relates to methods for loading a shipping carton (e.g., any of the exemplary cartons described herein). FIG. 7 is a flow diagram for one exemplary method 700 of loading a shipping carton, including, for example, one of the exemplary cartons 100 depicted and described above with respect to FIGS. 1-5.

The method 700 includes separating 710 two opposing flaps on a top panel of the carton so that the closable top opening is in an open configuration. In some examples, the flaps 112 may come initially separated so that this separation step is rolled in to the act of providing the carton.

The method 700 also includes loading 720 packages into the carton through the opening. The packages can be loaded from above the carton in a vertical orientation. For example, the packages may be arranged vertically, and loaded into the carton such that indicia on the packages read top down. The loading 720 can also include arranging the packages into two adjacent rows of vertical packages. The packages can also be loaded so that the indicia face toward the front surface of the carton.

After loading, the opposing flaps can then be folded 730 over the top opening so that the flaps adjoin along the top center line. That is, the flaps can be folded over the top to close off the opening with the packages stored therein.

The flaps can then be secured or taped 740 to close the opening by applying an adhesive strip or tape along at least a portion of the top center line. In some examples, the adhesive strip or tape can be applied to extend beyond the top surface and onto the opposing front and back panels of the carton. In this manner, the strip can be applied to protrusions on the front panel, whereby the protrusions are defined by the line of weakness that also defines the removable panel segment.

The loaded carton can then be shipped, for example, to a retail environment, whereby the carton can be arranged in a display configuration. For example, the carton can be arranged to rest on a second side so that the packages rest in a horizontal configuration. The removable panel segment can then be removed to display the horizontally arranged packages.

Figure 8:
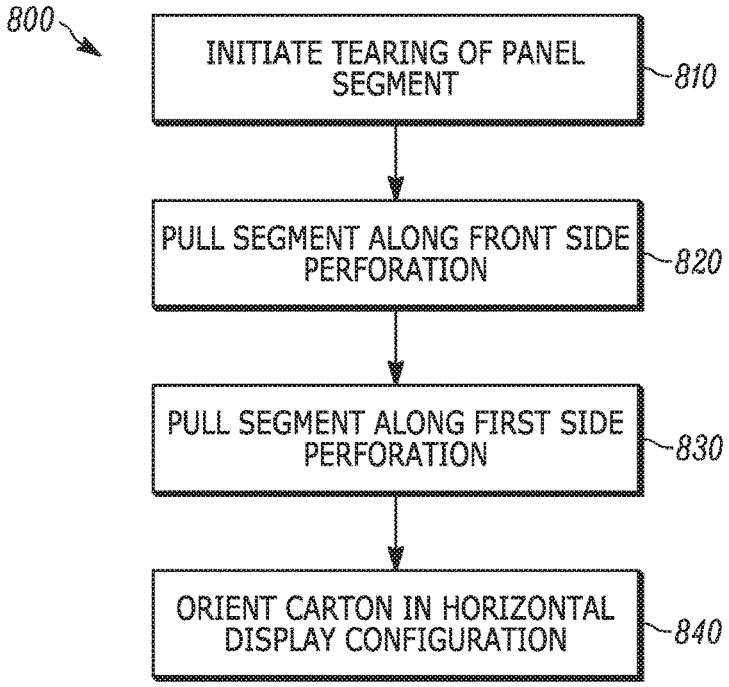
FIG. 8 is a flow diagram for a method of displaying products in a shipping carton in accordance with examples described herein.

The present disclosure also describes examples of methods for displaying products in a shipping carton. FIG. 8 provides a flow diagram for a method 800 of displaying products in a shipping carton, which can be, for example, the carton 100 depicted and described above with respect to FIGS. 1-5. In particular, method 800 involves displaying products that have been loaded into one of described cartons and then closed. In particular, the method 800 involves displaying packages that have been loaded in adjacent vertical rows (e.g. two adjacent vertical rows) into the shipping carton. In some examples, method 800 can be an extension of method 800 described above.

The method 800 includes initiating 810 the tearing of a removable panel segment on the carton. The initiating can include pushing in a punch hole or another portion along a line of weakness of the carton. After initiating the tearing, the method 700 involves removing a removable panel segment from the shipping carton by tearing the panel segment along a line of weakness that spans across at least a portion of the front surface of the shipping carton and at least a portion of an adjacent side surface of the shipping carton. For example, the method can include pulling 820 the segment along the front side perforation or line of weakness, and continuing to pull 830 the segment along the first side perforation or line of weakness to establish the complete display opening. The display opening displays the indicia on the front surfaces of the packaged products and that enables removal of the packaged products therethrough. The display opening also forms two protrusions on opposing sides of the front surface of the shipping carton, for example, protrusions 170 shown and described above with respect to FIGS. 1-5.

The method can also include orienting 840 the carton in horizontal configurations so that the two adjacent rows of packaged products are arranged with one row stacked upon the other. In this manner, vertically loaded packages can be displayed horizontally, or in an orientation that is rotated from the orientation by which they were loaded. For example, the packaged products arranged in the horizontal display configuration may be rotated 90 degrees from the orientation by which they were loaded into the shipping container.

It should be noted that the steps of method 800, in particular the orienting step 840, need not be performed in the order described above. That is, the orienting step 840 can be performed before, during, and/or after tearing 810 and pulling and removal steps 820, 830. For example, method 800 may include receiving the shipping carton and orienting the carton on a display shelf in the horizontal display configuration. The method 800 may then proceed to initiate the removal of the panel segment to display the packages stored therein.

The present disclosure describes preferred embodiments and examples of the present technology. Those skilled in the art will recognize that a wide variety of modifications, alterations, and combinations can be made with respect to the above described embodiments without departing from the scope of the invention as set forth in the claims, and that such modifications, alterations, and combinations are to be viewed as being within the ambit of the inventive concept. In addition, it should also be understood that features of one embodiment may be combined with features of other embodiments to provide yet other embodiments, as desired. All references cited in the present disclosure are hereby incorporated by reference in their entirety.

The invention claimed is:

1. A carton for storing and displaying packages, the carton comprising:

a side panel;

a front panel sharing a carton edge with the side panel;

a closable top adjacent the side panel and the front panel, the closable top comprising at least one flap that folds to close a top opening, the at least one flap including two opposing flaps that fold to adjoin along a top center line to close the top opening; and a removable panel segment spanning across at least a portion of the side panel and the front panel, the removable panel being removable to form a display opening, wherein the carton is configured to display packages through the display opening, and wherein the display opening forms two generally U-shaped protrusions on opposites sides of the front panel, the two generally U-shaped protrusions being positioned opposite each other and being generally aligned with the top center line; and wherein the removable panel segment includes two opposed generally U-shaped indentations each configured to receive a respective one of the two generally U-shaped protrusions prior to removal of the removable panel segment from the carton.

2. The carton of claim 1, wherein the display opening is sufficiently large to enable removal of the packages through the opening.

3. The carton of claim 1, wherein the carton comprises a first row of packages and an adjacent second row of packages, the first and second row of packages received into the carton through the top opening in a vertical orientation.

4. The carton of claim 3, wherein each of the packages have indicia on a front surface of the package, wherein the top opening is configured to receive the two adjacent rows of vertically oriented packages so that the indicia on the front surface of the packages face toward the front panel of the carton.

5. The carton of claim 4, wherein the display opening is configured so that the indicia on the front surface of at least one package within the carton is visible through the opening.

6. The carton of claim 3, wherein the carton is configured to display the packages in a horizontal orientation, whereby the first row packages is stacked upon the second row of packages in the horizontal orientation.

7. The carton of claim 6, wherein a portion of the display opening that extends along the side panel is sufficiently large to enable removal of packages therethrough.

8. The carton of claim 6, wherein the generally U-shaped protrusions extend over portions of both the first row of packages and the second row of packages.

9. The carton of claim 8, wherein each of the generally U-shaped protrusions extend across no more than 20 percent of a width of the display opening.

10. The carton of claim 1, wherein the removable panel segment is defined by a line of weakness that spans the side panel and the front panel.

11. The carton of claim 10, wherein the line of weakness defines at least one of a tapered segment or a parabolic segment to establish a wider display opening portion along the carton edge.

12. The method of claim 11, wherein the packaged products oriented in the horizontal display configuration are rotated 90 degrees.

13. A method of loading the carton of claim 1, wherein the method comprises:

arranging the closable top opening in an open configuration;

loading packages from above the carton into the carton through the opening, the loading including arranging the packages to form two adjacent rows of vertical packages within the carton so that the indicia of the packages face toward the front surface of the carton;

folding the at least one flap over the top opening so that the at least one flap adjoins with at least one of another flap or a carton panel; and closing the top opening by applying an adhesive strip over the top centerline, wherein at least a portion of the adhesive strip extends over and attached to at least one of the two U-shaped protrusions on the front panel.

14. A method of displaying the products of the carton of claim 1, wherein the carton comprises a first row of packages and an adjacent second row of packages, the first and second row of packages received into the carton through the top opening in a vertical orientation, the method comprising:

removing the removable panel segment from the shipping carton by tearing the panel segment along a line of weakness that spans across at least a portion of the front panel, the side panel, and the carton edge of the shipping carton; and orienting the shipping carton in a horizontal display configuration, whereby the two adjacent rows of packages are arranged with one row stacked upon the other.

15. The carton of claim 1, further comprising a second removable panel segment spanning across a portion of the side panel adjacent, the removable panel being removable to form a second display opening, wherein the carton is configured to display packages through the second display opening, and wherein the second display opening forms at least one protrusion on the front panel.

16. The carton of claim 15, wherein the second removable panel segment runs parallel with the removable panel segment.

17. A carton for storing and displaying packages, the carton comprising:

a side panel;

a front panel sharing a carton edge with the side panel;

a closable top adjacent the side panel and the front panel, the closable top comprising at least one flap that folds to close a top opening, the at least one flap including two opposing flaps that fold to adjoin along a top center line to close the top opening;

a removable panel segment spanning across at least a portion of the side panel and the front panel, the removable panel being removable to form a display opening, wherein the carton is configured to display packages through the display opening, and wherein the display opening forms two protrusions on opposites sides of the front panel, the two protrusions being positioned opposite each other and being generally aligned with the top center line; and wherein the removable panel segment includes two opposed indentations each configured to receive a respective one of the two protrusions prior to removal of the removable panel segment from the carton; and an adhesive strip overlapping the top center line and adjoining the two opposing flaps to close the top opening;

wherein at least a portion of the adhesive strip extends onto and is attached to at least one of the two protrusions on the front panel.

18. The carton of claim 17, wherein the at least one protrusion is wider than the adhesive strip so that the portion of the adhesive strip that extends onto the at least one of the two protrusions does not extend onto the removable panel segment.

* * * * *